United States Patent [19]

Stewart

[11] Patent Number: 4,781,053

[45] Date of Patent: Nov. 1, 1988

[54] INDIRECT EXTRUSION PROCESS AND MACHINERY THEREFOR

[76] Inventor: Charles L. Stewart, 1733 Addison Rd., Palos Verdes Estates, Calif. 90274

[21] Appl. No.: 836,629

[22] Filed: Mar. 5, 1986

[51] Int. Cl.[4] ..... B21C 23/02; B21C 27/00; B21C 33/00; B21C 35/04

[52] U.S. Cl. ..... 72/273.5; 72/255; 72/263; 72/265; 72/270; 72/272; 72/273

[58] Field of Search ..... 72/254, 255, 263, 265, 72/270, 272, 273.5, 273

[56] References Cited

U.S. PATENT DOCUMENTS

| | | | |
|---|---|---|---|
| Re. 30,688 | 7/1981 | Zilges et al. | 72/273.5 |
| 3,070,391 | 12/1962 | Hofmann | 72/272 |
| 3,083,827 | 4/1963 | Rosenthal | 267/15 |
| 3,120,304 | 2/1964 | Pahnke et al. | 72/263 |
| 3,156,359 | 11/1964 | Elger et al. | 72/263 |
| 3,182,479 | 5/1965 | Rosenthal | 72/263 |
| 3,186,208 | 6/1965 | Samuel | 72/263 |
| 3,197,994 | 8/1965 | Samuel et al. | 72/263 |
| 3,221,531 | 12/1965 | Salter | 72/263 |
| 3,228,226 | 1/1966 | Elger | 72/263 |
| 3,240,046 | 3/1966 | Salter | 72/263 |
| 3,241,345 | 3/1966 | Samuel et al. | 72/363 |
| 3,352,141 | 11/1967 | Boshold | 72/272 |
| 3,359,770 | 12/1967 | Asari | 72/255 |
| 3,475,942 | 11/1969 | Murphy et al. | 72/273 |
| 3,522,721 | 8/1970 | Whiting | 72/255 |
| 3,528,275 | 9/1970 | Sibler | 72/256 |
| 3,566,659 | 3/1971 | Cameron | 72/263 |
| 3,580,037 | 5/1971 | Issott et al. | 72/265 |
| 3,581,545 | 6/1971 | Asari | 72/263 |
| 3,798,953 | 3/1974 | Sgambati et al. | 72/255 |
| 3,839,894 | 10/1974 | Kent et al. | 72/263 |
| 3,842,641 | 10/1974 | Kent | 72/263 |
| 3,867,828 | 2/1975 | Kent et al. | 72/263 |
| 4,112,723 | 9/1978 | Asari et al. | 72/272 |
| 4,230,661 | 10/1980 | Asari et al. | 264/323 |
| 4,244,205 | 1/1981 | Boshold | 72/263 |
| 4,365,497 | 12/1982 | Oblon et al. . | |
| 4,379,398 | 4/1983 | Asari et al. | 72/253.1 |
| 4,399,676 | 8/1983 | Noyori et al. | 72/40 |
| 4,424,696 | 1/1984 | Asari et al. | 72/273.5 |
| 4,425,775 | 1/1984 | Fuchs, Jr. | 72/270 |
| 4,606,211 | 8/1986 | Noyori et al. | 72/273.5 |
| 4,631,949 | 12/1986 | Iwata et al. | 72/270 |
| 4,696,176 | 9/1987 | Asari et al. | 72/273.5 |

FOREIGN PATENT DOCUMENTS

| | | | |
|---|---|---|---|
| 1002483 | 12/1976 | Canada . | |
| 660941 | 7/1929 | France | 72/263 |
| 1163770 | 9/1958 | France . | |
| 4448 | 2/1967 | Japan | 72/263 |
| 103062 | 9/1976 | Japan | 72/273.5 |
| 2887 | 1/1984 | Japan | 72/273.5 |
| 262472 | 7/1927 | United Kingdom | 72/273.5 |
| 318113 | 8/1929 | United Kingdom | 72/273.5 |
| 370274 | 4/1932 | United Kingdom | 72/273.5 |
| 894737 | 4/1962 | United Kingdom | 72/273.5 |

*Primary Examiner*—Lowell A. Larson
*Attorney, Agent, or Firm*—Spencer & Frank

[57] ABSTRACT

An indirect extrusion process, and apparatus therefor, for producing an extrusion product from a hot metal billet. A press container is mounted to be substantially axially stationary during extrusion of a billet. A hot billet, a die and a pressure disc are located into the axial throughbore of the container so that the billet is sandwiched between the die and pressure disc, with the pressure disc having a maximum outer diameter between opposite radial faces which is slightly less than the diameter of the axial throughbore to define a diametrical clearance between the pressure disc and the press container. A bolster is located adjacent the pressure disc and is axially fixed to substantially prevent axial movement of the pressure disc in a direction toward the bolster during extrusion. The bolster exerts a relatively insigificant axial force against the container. An elongated stem having an axial passage is moved into the throughbore of the container to press the die toward the bolster, causing the billet to be extruded through the die to create an extrusion product which exits the container through the axial passage in the stem, while extrusion of the billet through the diametrical clearance between the pressure disc and the container is substantially avoided.

19 Claims, 9 Drawing Sheets

CLEANING
LOADING
DISCARD
EXTRUSION
63
69
71
73
74C
107
103
104
105
75D
21C
75C
85
21B
109
61B
67
106
99
74D
21D
74B
79A
79B
77A
77B
75B
21A
10
74A
75A
61C
65A
61A
101

INDIRECT EXTRUSION PROCESS AND MACHINERY THEREFOR

BACKGROUND OF THE INVENTION

The present invention concerns an indirect extrusion process for producing an extrusion product from a hot metal billet, and to an extrusion press and related apparatus for carrying out the indirect extrusion process. The invention further relates to an indirect extrusion process employing a multiple container press turret whereby the containers on the press turret are sequentially rotated through the extrusion axis of the press where the extrusion actually takes place and through various working stations off of the extrusion axis where other functions are performed, such as removing the discard from the press container, cleaning the press container and loading a new billet into the press container.

Extrusion presses employing multiple container turrets of the above type are known. The purpose of such a press is to maximize the efficiency of the press by minimizing the number of operations on the extrusion axis which are not involved in the actual extrusion of the billet. Thus, by performing operations such as discard removal, container cleaning, and billet loading at stations off of the extrusion axis, the press cycle time can be considerably reduced.

Multiple container press turrets are generally employed in connection with a direct extrusion process. In direct extrusion, a die is held tightly against one end of the container and a billet disposed in the cavity of the container is pressed through the die by a ram entering the container cavity from the side opposite the die. The direct extrusion process subjects the container to great axial forces in that the die must be pressed tightly against the one end of the container with sufficient force to withstand the separating forces that occur between the die and container as the billet is pushed through the die. Additionally, the container is subjected to an axial frictional force on its inner surface by the billet as it is being pressed through the container by the ram.

In order to secure the container against axial movement relative to the press turret in the presence of such large axial forces, it has been necessary to secure the container to the turret with a correspondingly substantial retaining mechanism. If it becomes necessary to change a container, for example so that a different diameter billet can be extruded, it can be a painstaking and time consuming process to release such a container from the turret and to secure a different container in its place. Since the entire press is inoperative during the time it takes to change a container, the overall efficiency of the press is greatly reduced.

Indirect extrusion presses are known whereby a container with a billet disposed therein is forced over a stationary die mounted at the end of a hollow stem. The indirect extrusion process eliminates one source of axial force on the container in that the billet does not move with respect to the container so that the axial frictional forces which are incurred in the direct extrusion process are avoided. However, in an indirect extrusion press it is still necessary to seal the back end of the container cavity, and this is generally done by pressing a sealing plate tightly against the back end of the container by a force which is sufficient to overcome the separating forces that occur between the container and the sealing plate. Thus, in the indirect extrusion process the container is also typically subjected to substantial axial forces. In the case of a multiple container turret, it is a complex task fraught with many pitfalls to implement an indirect extrusion process utilizing a conventional sealing plate at the back end of the container. If the indirect extrusion process were to be implemented with a multiple container turret in the conventional manner, the entire turret would have to be axially moveable in order to pass the container over the die, and a substantial axial force on the container would be required to ensure an effective seal by the sealing plate at the back end of the container as previously discussed. This results in a complex solution for fixing axial movement of the container relative to the turret which in turn raises difficulties in terms of overall press efficiency in connection with the changing of a container when this becomes necessary. Multiple container turrets are therefore generally employed in connection with a direct extrusion process rather than indirect extrusion, since the container and turret generally remain axially stationary in the direct extrusion process.

SUMMARY OF THE INVENTION

It is an object of the invention to provide improvements to an indirect extrusion process and apparatus therefor to provide economic efficiencies with which metal extrusion products are made.

It is a further object of the invention to provide an indirect extrusion process and apparatus therefor wherein the press container is subjected to insignificant axial forces during the extrusion of a billet.

It is a further object of the invention to implement such an indirect extrusion process utilizing a multiple container press turret.

It is yet another object of the invention to facilitate the loading of a billet and tooling into a press container of a multiple container press turret.

It is a further object of the invention to simplify and reduce the time required for removing and replacing a press container on the press turret.

It is yet a further object of the invention to facilitate the removal of the discard from a container at the conclusion of the extrusion cycle.

The above and other objects are accomplished in accordance with the invention by the provision of an indirect extrusion process for producing an extrusion product from a hot metal billet, including:

(a) mounting a press container, having an axial throughbore, to be substantially axially stationary during extrusion of a billet;

(b) loading a hot metal billet, a die and a pressure disc into the axial throughbore of the press container so that the billet is sandwiched between the die and pressure disc, with the die having an opening through which the billet is to be extruded to form an extrusion product, and the pressure disc having opposite radial faces and a maximum outer diameter between such faces which is slightly less than the diameter of the axial throughbore to define a diametrical clearance between the pressure disc and the press container;

(c) locating a bolster adjacent to the radial face of the pressure disc which is remote from the billet and axially fixing the bolster to substantially prevent axial movement of the pressure disc in a direction toward the bolster during extrusion and so that the bolster exerts a relatively insignificant axial force against the container; and (d) moving an elongated stem having an axial passage into the throughbore of the container to press the die toward the bolster causing the billet to be extruded through the die to create an extrusion product which exits the container through the axial passage of the stem, while extrusion of the billet through the diametrical clearance between the pressure disc and the container is substantially avoided.

It has been found that by making the diametrical clearance between the pressure disc and container small enough, the pressure disc becomes self-sealing, i.e. billet material is substantially prevented from flowing out the back end of the container through the gap between the pressure disc and container. With this technique it is not necessary to provide a separate sealing plate with a radial surface which is pressed tightly against the back end of the container as done in the past. With the use of a self-sealing pressure disc according to the invention, it is only necessary to axially fix a bolster immediately behind the pressure disc to prevent the pressure disc from axially moving out the back end of the container during extrusion. Thus, the use of a self-sealing pressure disc according to the present process does not involve the application of any external axial force against the container for the purpose of sealing the container against the extrusion of billet material at the back end of the container. Furthermore, the use of such a self-sealing pressure disc in combination with an indirect extrusion process, which is accomplished by moving the die through an axially stationary container, results in substantially no axial forces whatsoever being applied to the container during extrusion.

The elimination, for all practical purposes, of axial forces on the container during extrusion has several important advantages, one of which is that the container may be secured with respect to axial movement by a relatively simple latch which can be easily and quickly released when it becomes necessary, for example, to change a container.

According to a further aspect of the invention, the indirect extrusion process employing the self-sealing pressure disc as described above is carried out with a multiple container press turret. This leads to several additional advantageous ramifications. For example, because the pressure disc has a maximum outer diameter less than the throughbore of the container, and thus fits entirely within the container, it is possible to load the billet as a unit with the die and pressure disc at a loading station off of the extrusion axis after which the loaded container can be brought into alignment with the extrusion axis to carry out the extrusion.

According to a further advantageous feature of the invention, a second turret having a plurality of container holders for slidably accommodating a container is mounted axially adjacent the press turret so that the second turret can be rotated for placing one of its container holders into a transfer position wherein a press container can be transferred from one to the other of the turrets by sliding the container in the axial direction. A container may be transferred from the press turret to the second turret, for example, by rotating the press turret to place the container to be removed in an off axis station and into a coaxial relationship with a container holder in the second turret. The latch securing such press container against axial movement in the press turret is then released so that the press container can be pushed into the container holder of the second turret. The second turret can then be rotated to bring a replacement container into coaxial relationship with the vacant container holder of the press turret so that the replacement container can be slid into the press turret.

According to a further feature of the invention the second turret is provided with one or more discard canisters. The second turret can then be rotated to bring a respective one of the discard canisters into alignment with a press container at a station off of the extrusion axis for receiving a discard from the press container after an extrusion cycle of the press.

Additional advantages and features of the invention will become apparent from the following description taken in conjunction with the accompanying drawings.

DESCRIPTION OF THE PREFERRED EMBODIMENTS

Figure 1:
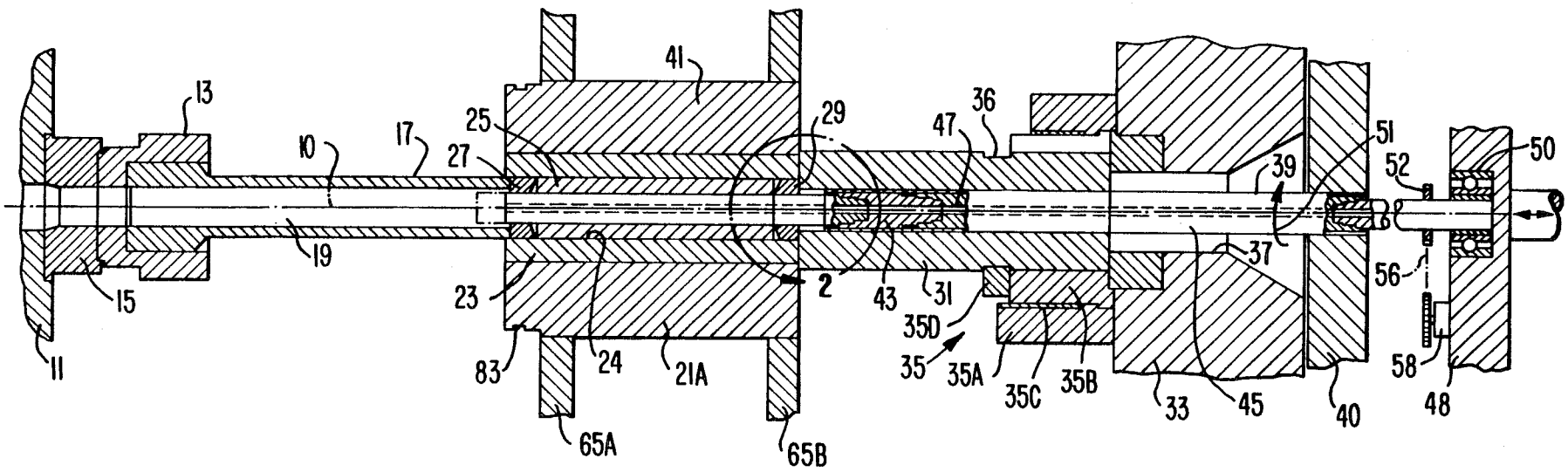
FIG. 1 is a partial longitudinal sectional view of an indirect extrusion press for implementing the process according to an embodiment of the invention.

Referring to FIG. 1, there is illustrated a partial longitudinal sectional view along the extrusion axis 10 of an indirect extrusion press employed according to one embodiment of the invention. At the far left-hand side of FIG. 1 a partially shown moving cross head 11 supports a tool socket 13 via an intermediary connecting member 15. Cross head 11 is connected at its other side to a main ram (not shown) for driving cross head 11 back and forth in the direction of extrusion axis 10. Tool socket 13 is adapted for accommodating a hollow stem 17. Cross head 11, intermediary member 15, and socket 13 each have a central throughbore which together with hollow stem 17 define a common central passage 19 which serves as an exit passage for the extrusion product, which as will be explained, moves to the left in FIG. 1 through passage 19.

A press container 21A, including in the usual manner a container liner 23 provided with a throughbore 24, is shown centrally disposed on extrusion axis 10. Container 21A is mounted to be substantially axially stationary during extrusion and in a preferred embodiment is one of a plurality of press containers 21A to 21D mounted on a rotatable press turret 63 as will be described in connection with FIG. 3. The circular end plates 65A and 65B of the press turret are partially shown in FIG. 1.

Container 21A is shown in FIG. 1 as being loaded with a previously pierced and heated metal billet 25 sandwiched between a die 27 and a pressure disc 29. A bolster 31 is shown aligned with extrusion axis 10 between the container 21A and a press platen 33. Bolster 31 is mounted on a slide mechanism 35 for sliding the bolster 31 in a horizontal direction transverse to the extrusion axis. Slide mechanism 35 includes a slide rail 35A bolted to platen 33, a slide 35B mounting bolster 31, a bronze bearing surface 35C provided on support rail 35A, and a U-shaped retainer 35D fixed to slide 35B and engaging in a circumferential groove 36 of bolster 31 for restraining axial movement of the bolster. Bolster 31 has a throughbore 35 which can be aligned on extrusion axis 10 with the throughbore 24 of the container and with a central passage 37 in platen 33 for receiving a mandrel assembly 39. Reference numeral 40 identifies a fixed crosshead which is fastened to platen 33.

Mandrel assembly 39 includes a mandrel 41, a mandrel adapter 43 and a mandrel bar 45. Mandrel bar 45 is connected via a moving crosshead 48 to a cylinder-piston (not shown) for controllably moving the mandrel assembly along the extrusion axis. As shown in FIG. 1, mandrel 41 is fully inserted in container 21A, defining with die 27 an annular space (visible in FIG. 2) through which billet 25 is extruded.

Preferably, mandrel assembly 39 has a central conduit 47 for carrying a cooling fluid which exits the free end of mandrel 41 for cooling the tubular extrusion product from the inside immediately as it exits die 27. Additionally, mandrel 41 is preferably provided with a shoulder 49 (see FIG. 2.), which is slightly greater in diameter than the rest of mandrel 41 for cooperating with die 27 to shear the extrusion product from the remaining portion of the billet at the end of an extrusion cycle as explained below.

During an extrusion cycle of the press illustrated in FIG. 1, crosshead 11 is caused to move toward the right by action of the main ram (not shown). Stem 17 thus presses against die 27 with sufficient force to cause the die to move through the container, extruding the billet through the diametrical clearance between die 27 and mandrel 41. The die stops just short of the pressure disc, leaving a residual portion of the billet, referred to as a butt, which is then severed from the extrusion by a movement of the mandrel toward the left in FIG. 1 which moves shoulder 49 of the mandrel toward the throat of the die, shearing the extrusion from the butt. This is more clearly shown in FIG. 2 which illustrates an enlarged view in the area of the die and pressure disc at the conclusion of the extrusion cycle just prior to the billet being severed from the extrusion.

Preferably the longitudinal movement of the mandrel assembly which shears the extrusion product from the butt is combined with a rotational motion (shown by arrow 51 in FIG. 1) of the mandrel assembly about its longitudinal axis which provides a cleaner and more efficient shearing action than just a linear movement alone. Rotation of mandrel assembly 39 can be achieved by rotatably mounting mandrel bar 45 to moving crosshead 48 via a bearing block 50. A ring gear 52 surrounding mandrel bar 45 is then drivingly connected by a chain 56 to a controllable motor 58 mounted to crosshead 48 for controllably rotating the mandrel assembly during the shearing action. Subsequent to shearing, the mandrel assembly is retracted, permitting the bolster to be moved horizontally out of the way for subsequent operations.

Figure 2:
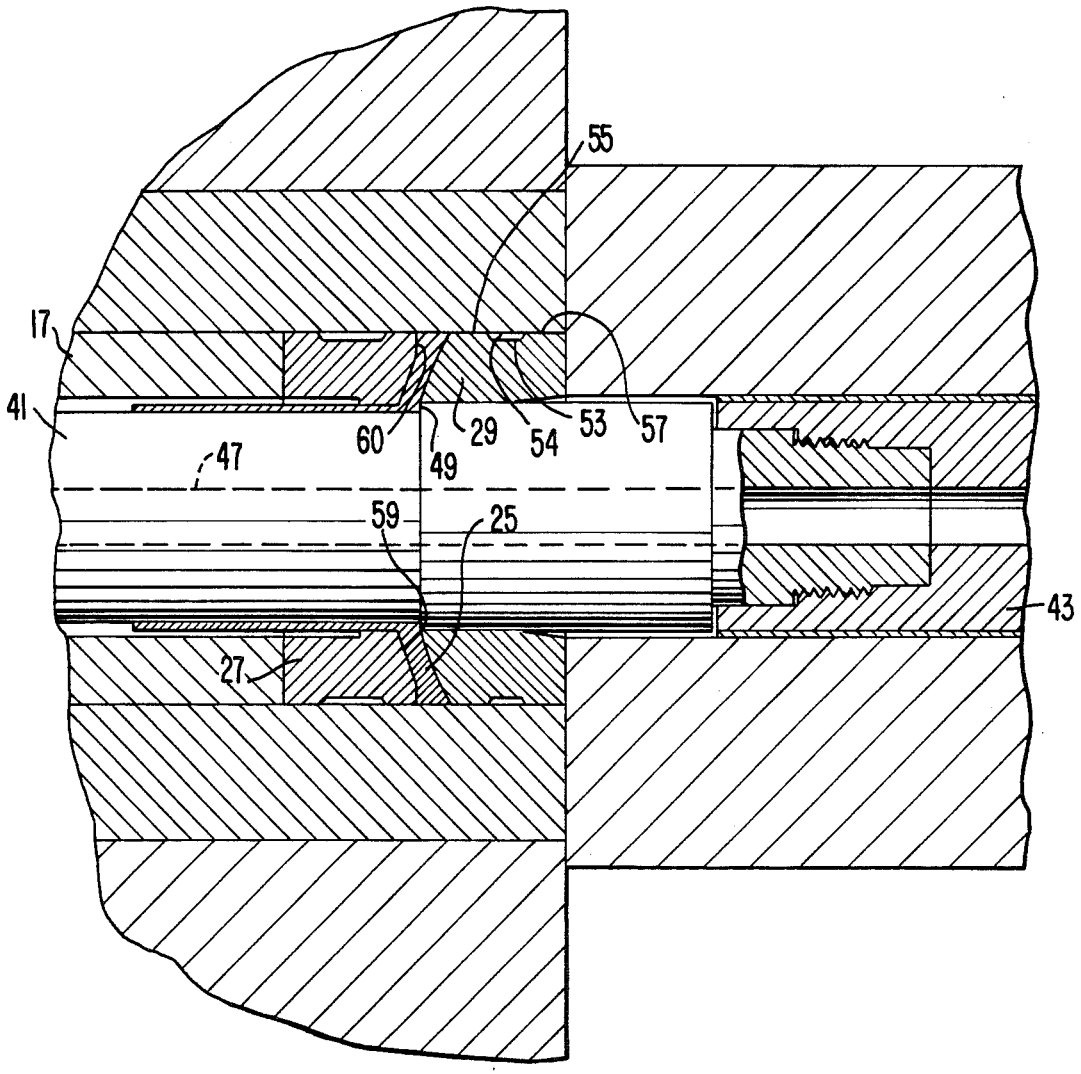
FIG. 2 is an enlarged view of a portion of FIG. 1.

As shown in FIGS. 1 and 2, the pressure disc 29 is disposed entirely within the throughbore of the container. This is contrary to the usual arrangement in an indirect extrusion press wherein, in order to seal the container at the end opposite the die, a sealing plate was provided having at least a portion thereof that was disposed outside the container and which had an outside diameter greater than the inside diameter of the cavity so as to present a radial surface which could be pressed tightly against the end surface of the container. Generally speaking, a force had to be applied to such a sealing plate, and hence to the end face of the container, which was sufficient to overcome the compressive forces on the billet which would otherwise tend to separate the sealing plate from the container.

According to one feature of the invention, the pressure disc 29 is designed to be self-sealing, thus avoiding the heretofore required axial force applied against the end of the container via a sealing plate to overcome the force tending to separate the sealing plate from the end of the container. According to this feature, the pressure disc is provided with a maximum outside diameter which is slightly less than the inside diameter of the container so as to create a diametrical clearance or gap, between the container and the pressure disc which presents an extrusion ratio that is high enough to substantially prevent extrusion of billet material through this gap. As a practical matter the extrusion ratio of such gap may range from a value roughly corresponding to the extrusion ratio of the extrusion product at the output of the die and upward, the extrusion ratio being the quotient of the cross sectional area of a billet divided by the cross sectional area of the extrusion. As the extrusion ratio for the extrusion product is increased, the diametrical clearance between the pressure disc and container would desirably be reduced. An increasing degree of safety could be expected when the ratio between the extrusion ratio of the clearance between pressure disc and container, on the one hand, and the extrusion ratio of the extrusion product at the output of the die, on the other hand, is increased. Preferably, the ratio between such extrusion ratios will be in the range of 3 and 5 to 1.

The use of the self-sealing pressure disc according to the invention involves the use of the bolster 31 supported by the press platen 33 which absorbes the compressive forces applied against the billet. Thus, while the counter-force provided by stationary bolster 31 prevents the pressure disc from being pushed out the back end of the container and effectively seals the back end of the container, the container itself does not experience the application of an axial force by this sealing technique. Furthermore, because the frictional force between the billet and container is substantially eliminated in the indirect extrusion process, in that the billet remains stationary with respect to the container, the container is not subjected to any substantial axial forces whatsoever during the extrusion cycle.

Referring to FIG. 2, the pressure disc is preferably provided with an annular recess 53 on its outer circumferential surface forming a cavity 54 between first and second diametrical clearances 55 and 57, respectively, formed between the pressure disc and container adjacent the billet 25 and adjacent the back end of the container, respectively. Cavity 54 serves as a fill space if for any reason metal should be extruded through the first diametrical clearance 55. The cavity 54 provides a "break zone" so that if metal is forced into this cavity it would be necessary for the full extrusion pressure to be developed within this cavity to cause a further flow of metal through the second diametrical clearance 57. Furthermore, the release of pressure on the metal as it flows into cavity 54 produces a chilling of the metal so that an even greater pressure would be required to restart the flow beyond the cavity.

As an example of a pressure disc constructed according to the invention for extruding a 6½ inch (16.25 cm) diameter billet to produce an extrusion product having an extrusion ratio between 30 and 140, a pressure disc may be used which has a convex face on the side adjacent the billet with a 6½ inch (16.25 cm) spherical radius, a maximum width of 2½ inches (6.25 cm) with a ½ inch (1.25 cm) wide by 1/16 inch (0.156 cm) deep annular recess centered on the outer circumferential surface. The maximum diameter of the pressure disc can be such as to provide an annular gap between the pressure disc and the container which has a width between 0.005 and 0.01 inches (0.0125 to 0.025 cm) and still provide adequate sealing.

According to a further aspect of the invention, the die is preferably provided with similar diametrical clearances with respect to the container and a similar annular recess as described in connection with the pressure disc. It has been found that the construction of a die in this manner minimizes the production of a skull in the container as is commonly produced by previously known dies used in an indirect extrusion process. As shown in FIG. 2 the die is provided with a generally concave face 59 adjacent the billet. Preferably, the face 59 is provided with an annular region 60 adjacent the outer circumference which is flat, i.e. lies in a plane perpendicular to the extrusion axis. It has been found that such a flattened region minimizes abrasion of the die on its circumferential surface, particularly toward the side of stem 17.

In one example of a die according to this aspect of the invention for extruding a 6½ inch (16.25 cm) diameter billet, the concave face 59 was given a 6½ inch (16.25 cm) spherical face radius with the outer half inch (1.25 cm) of face 59 being flattened out. Preferably, the flattened region 60 will comprise approximately 15%–20% of the area of face 59.

Figure 3:
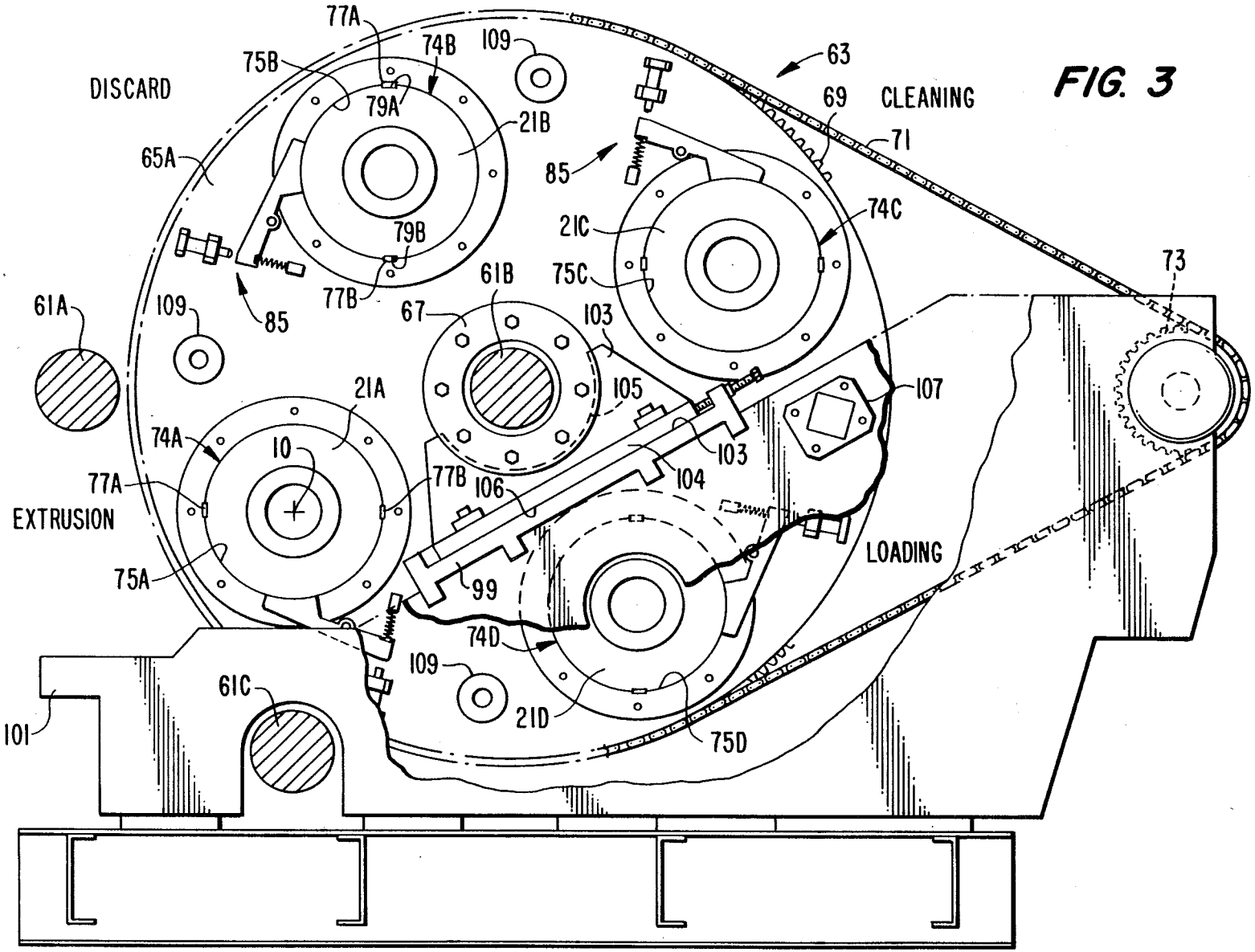
FIG. 3 is an end elevational view of a multiple container press turret which could be used in the press of FIG. 1.

FIG. 3 shows a multiple container press turret 63 for use in the press of FIG. 1 and embodying various additional features according to the invention. Press turret 63 mounts four press containers 21A–21D, each corresponding in structure to container 21A illustrated in FIG. 1. Containers 21A–21D are spaced apart by 90° and each has its longitudinal axis on the same radius relative to the center of the turret. Press turret 63 is itself mounted to be substantially axially stationary and to be rotatable for moving containers 21A–21D in seriatim through an extrusion station, a discard station, a cleaning station and a loading station as generally indicated by the labels in FIG. 3. Container 21A is located at the extrusion station, aligned with extrusion axis 10, and the other containers 21B–21D are at the other stations off of the extrusion axis as shown.

The press includes three tie rods 61A, 61B and 61C connected between the press platens (not shown in FIG. 3). Press turret 63 is mounted for rotation about tie rod 61B. Turret 63 is comprised of two circular plates 65A and 65B, which are mounted on a hub 67 surrounding tie rod 61B. Plates 65A and 65B are both partially shown in FIG. 1. Only plate 65A is shown in FIG. 3. One of the circular plates of turret 63 is provided with a ring gear 69 for accommodating a drive chain 71 which is also engaged by a smaller gear 73. Gear 73 is connected in a suitable manner to a high inertia electrical or hydraulic motor and break system which is used to advance, stop and position the turret in a known manner.

Press turret 63 has four container holders 74A–74D formed by four circular openings provided in each plate, with the openings of one plate being in registration with the openings of the other plate. The openings in plate 65A are designated 75A through 75D. Two guide bars 77A and 77B extend diametrically opposite one another in each holder, from the periphery of the opening in one plate to the periphery of the registered opening in the other plate. Containers 21A through 21D are disposed in a respective one of the holders 74A–74D. Each container is provided with a pair of diametrically opposed axial grooves 79A and 79B so that containers 21A through 21D are slidably accommodated in a respective one of the holders 74A through 74D via the guide bars 77A and 77B.

Figure 4:
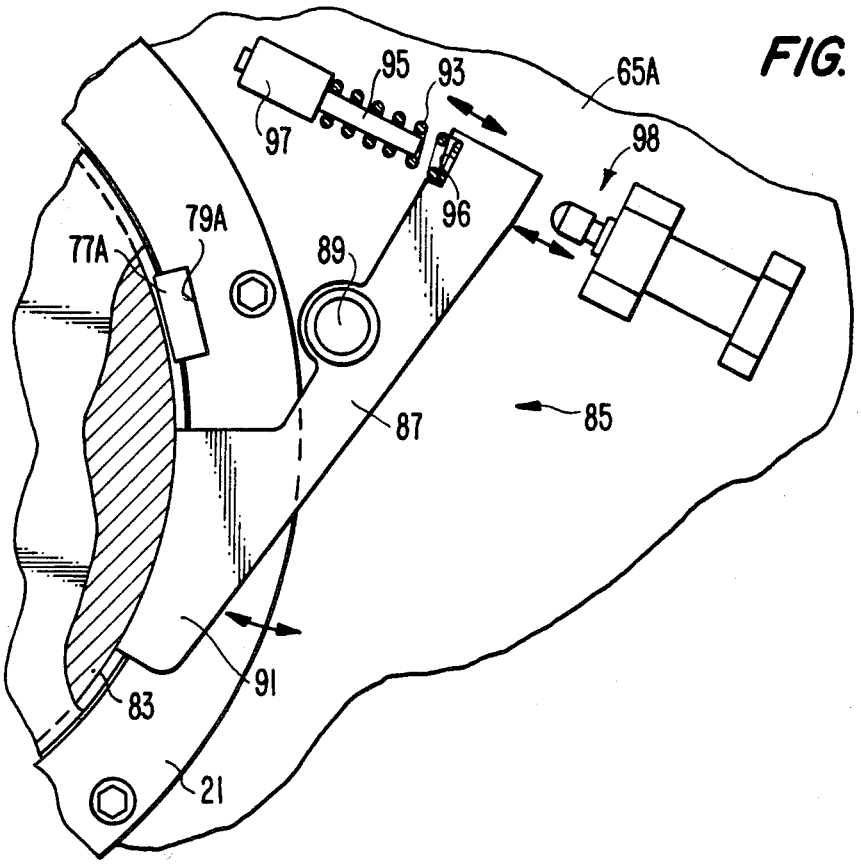
FIG. 4 is a partial end elevational view of a container with a container locking assembly.

Each container has a projection which extends beyond the surface of plate 65A and which is provided with an annular groove 83 as shown in FIGS. 1 and 4. Each container is axially fixed with respect to turret 63 by a single, quick release, latch mechanism 85 shown generally in FIG. 3 and in greater detail in the enlarged view of FIG. 4.

Referring to FIG. 4, latch mechanism 85 includes a lever 87 pivotable about a pin 89 connected to and projecting from plate 65A. Lever 87 is provided at one end with an enlarged head 91 which is configured for engaging the container along an arcuate segment of annular groove 83. Lever 87 is held in a position of engagement with the container by a spring 93 mounted on a pin 95 which is fastened via a fastener 97 to the face of plate 65A. Lever 87 is provided with a recess 96 for receiving the end of spring 93. A hydraulically actuated piston 98 is mounted adjacent each lever 87, opposite spring 93, for disengaging head 91 from groove 83 upon command by rotating lever 87 about pin 89 in a direction counter to the biasing force of spring 93. Instead of providing a separate hydraulically actuated piston for each lever 87, a single hydraulically actuated piston may be suitably attached to structure (not shown) external to the turret 63 for engaging a respective one of the levers 87 when a given container is in the discard position, which can also serve as a container changing position as will be described in connection with FIGS. 10 to 12.

A recurring problem with multiple container turrets is the proper alignment of the longitudinal axes of the respective containers with the extrusion axis of the press. This is a two part problem in that the press turret must be initially mounted so that the longitudinal axis of each container can be rotated into coincidence with the extrusion axis, and the rotation of the turret must be controllable for advancing and stopping the turret for precisely aligning the longitudinal axis of a respective one of the containers with the extrusion axis. The press turret illustrated in FIG. 3 solves both of these problems.

As shown in FIG. 3, a lower mounting bracket 99 is affixed to a mounting platform 101 to provide a linear surface 103 which is parallel to a line passing through the extrusion axis 10 and the center of tie rod 61B. An upper mounting bracket 104 is provided which has a semicircular recess 105 for accommodating hub 67 and a linear surface 106 which rests against surface 103. Upper mounting bracket 104 is constructed for placing the center of hub 67 of the imaginary line connecting the extrusion axis with the center of tie rod 61B. It is then only necessary to move upper mounting bracket 104 along surface 103 until the longitudinal axis of one of the containers reaches coincidence with the extrusion axis. Upon that occurrence, the position of bracket 104 along surface 103 is fixed by bolting and/or welding bracket 104 to the lower mounting bracket 99. Similar mounting brackets are arranged on the exterior side of the other press plate 65B (not shown in FIG. 3).

With the press turret having been mounted so that the longitudinal axes of the containers can be rotated through the extrusion axis, it is further necessary to provide an accurate stop mechanism for assuring that the longitudinal axes of the containers can be stopped precisely on the extrusion axis. The high inertia motor and brake system which indexes the turret is capable of stopping the turret to provide a coarse alignment of a container with the extrusion axis. A further adjustment is then necessary to bring the longitudinal axis of the container into substantial coincidence with the extrusion axis.

To accomplish this, two hydraulically actuated lock pin assemblies are mounted to mounting platform 101, one on each side of turret 63, with the one on the side of plate 65A being shown generally at 107 in FIG. 3. Each lock pin assembly 107 is actuatable for inserting a pin into a respective one of four recesses 109 which are provided on plate 65A and which are located so that when the assembly 107 is actuated to insert its pin into one of the recesses, the turret is locked in a position with a corresponding one of the containers having its longitudinal axis precisely aligned with the extrusion axis of the press.

Figure 5:
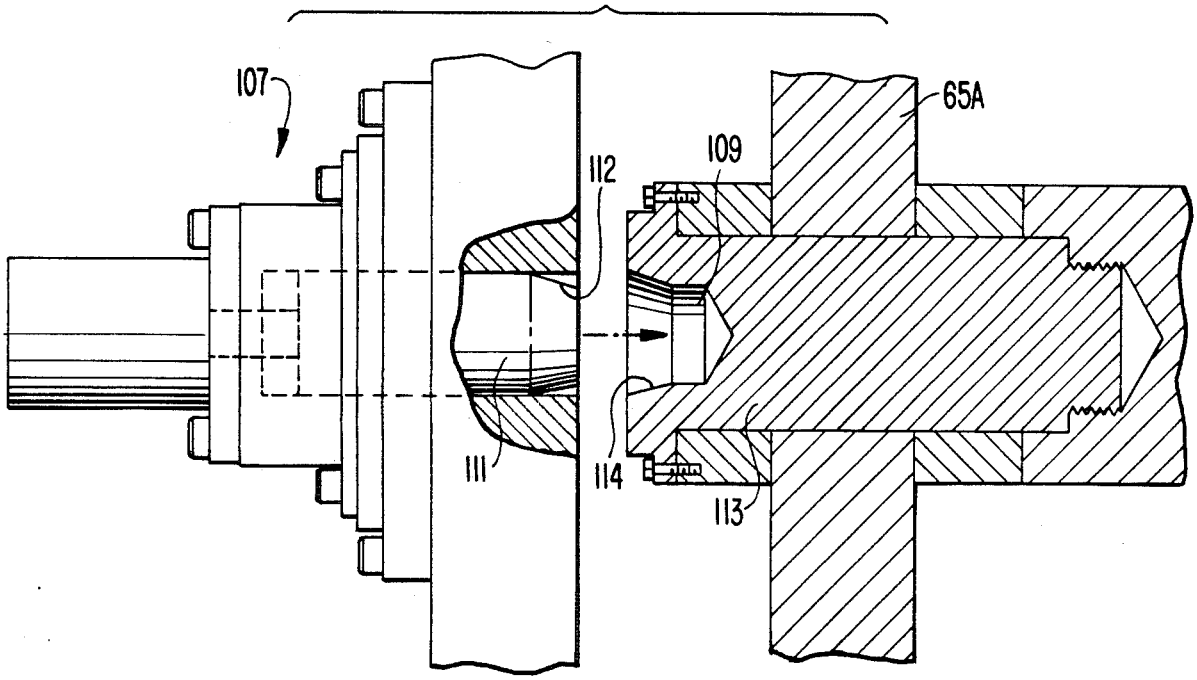
FIG. 5 is a side sectional view of a turret lock pin assembly for the turret shown in FIG. 3.

FIG. 5 illustrates a side sectional view of a lock pin assembly 107, comprising a hydraulically actuated lock pin 111 which has a bevelled end portion 112. Lock pin assembly 107 is shown in cooperating relationship with a recess 109 provided in a plug 113 which is fixed to plate 65A. Recess 109 has a bevel 114 corresponding to the bevelled end portion 112 of pin 111.

In operation, the drive motor (not shown) for chain 71 is capable of advancing and stopping turret 63 to provide a coarse positioning of a container with respect to extrusion axis 10. The bevelled portions of the lock pin 111 and the lock pin recess 109 overcome and correct for any residual error in the positioning of the turret by the drive motor. Once engaged, the lock pin assemblies firmly confine a corresponding one of the containers in precise alignment with the extrusion axis of the press.

Figure 6:
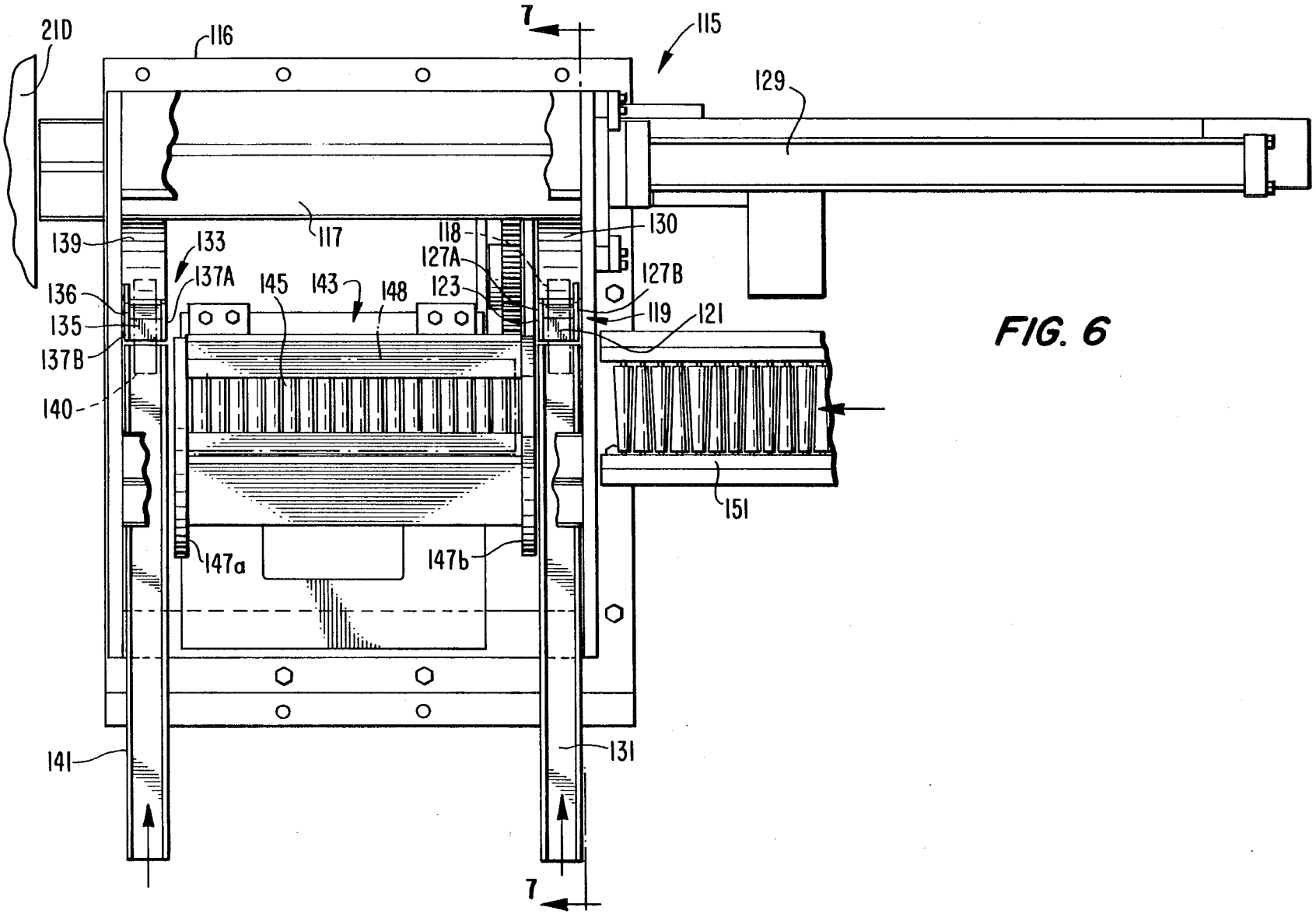
FIG. 6 is a plan elevational view of a loading assembly for loading a billet, die and pressure disc into a press container of the press turret shown in FIG. 3.
Figure 7:
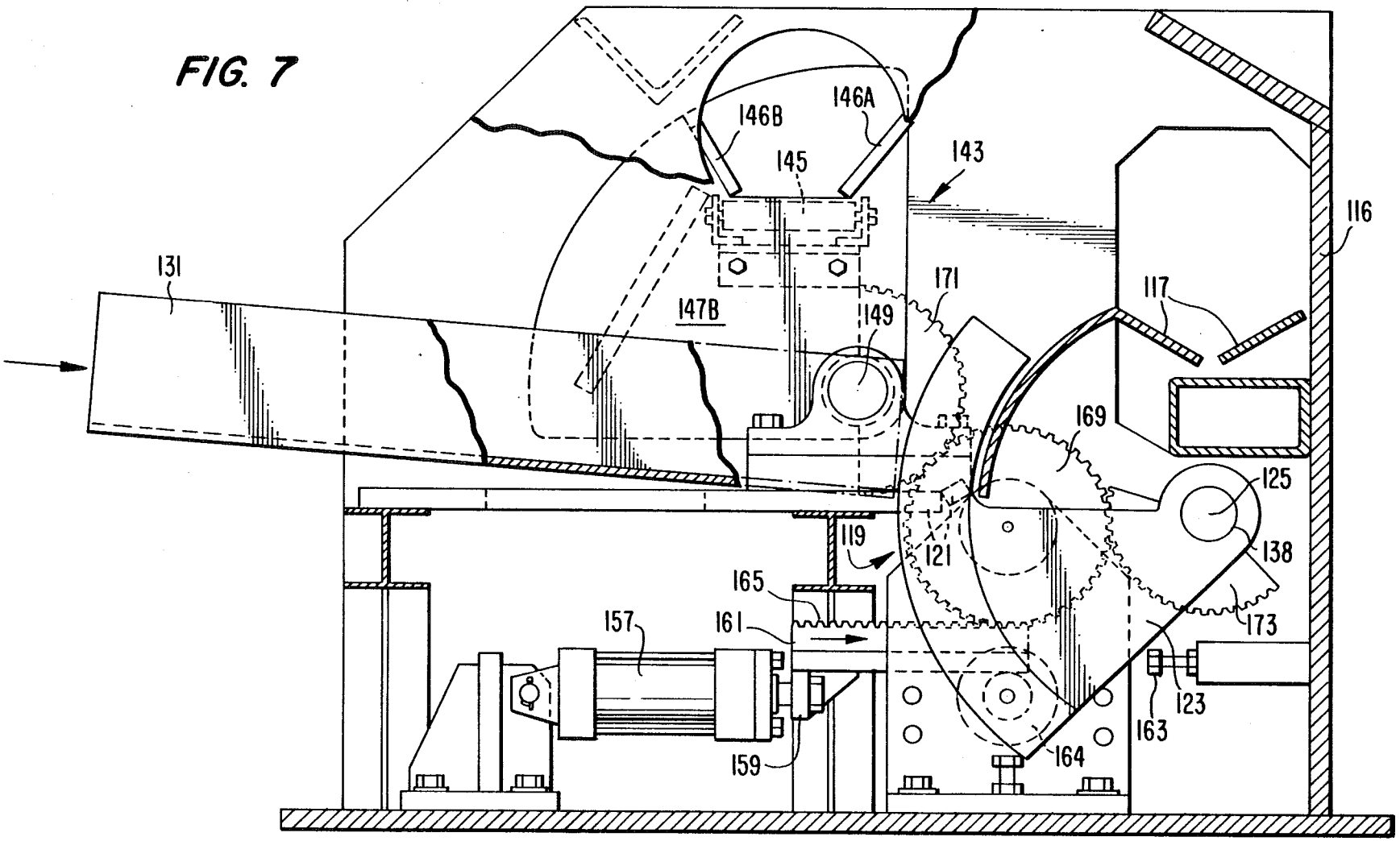
FIG. 7 is an end sectional view along line 7—7 of FIG. 6.

FIGS. 6 to 9 illustrate a billet and tool loader which is designed to load, as a unit, a heated billet sandwiched between a pressure disc and a die into the cavity of a container which is brought into a loading position off of the extrusion axis by the press turret. Referring initially to FIGS. 6 and 7 together, there is shown a loading assembly 115 comprising a frame 116 supporting a V-shaped loader tray 117 positioned between a container (such as a container 21D at the loading station of the turret 63 in FIG. 3) and a loading cylinder-piston 129 which has a piston which can be extended for pushing a die, billet and pressure disc, coaxiallly aligned on loader tray 117, into the cavity of the container.

Tray 117 receives a pressure disc from a pressure disc transporter 119 which includes a tray 121 adapted to support a pressure disc 118, shown in phantom standing on its circumferential surface. Tray 121 is connected to a pivot arm 123 which pivots about a pivot axis 125. Transporter 119 has upward arcuate projections 127A and 127B on either side of tray 121 which prevent a pressure disc standing on its circumferential surface from tipping over. A stationary arcuate surface 130 is positioned to prevent a pressure disc from falling out of tray 121 as arm 123 is pivoted upwardly until the disc reaches loader tray 117. Pressure discs are inserted into tray 121 by way of a chute 131 which comprises a ramp having a U-shaped cross section and being inclined slightly downwardly toward tray 121 for rolling a pressure disc which is received from a store (not shown) of pressure discs into tray 121.

Loader tray 117 receives a die from a die transporter 133 which is constructed similarly to pressure disc transporter 119 except that it is positioned at the end of loader tray 117 adjacent container 21D. Die transporter 133 thus includes a tray 135, a pivot arm 136, upward arcuate projections 137A and 137B and a stationary arcuate surface 139. Tray 135A receives die 140 (shown in phantom) from a die store (not shown) via a die chute 141 which also is constructed similarly to pressure disc chute 131. A side elevation of the die chute and die transporter is not separately illustrated, however, it should be understood that such a view would look the same as the side elevation of the pressure disc chute and transporter illustrated in FIG. 7 and the die transporter operates in a manner corresponding to that of pressure disc transporter 119 for transporting a die to loader tray 117. Pivot arm 123 of pressure disc transporter 119 and pivot arm 136 of die transporter 133 are rigidly connected together by a shaft 138 concentric with pivot axis 125 so that both transporters move in synchronism via the drive mechanism described below.

Loader tray 117 receives a heated billet from a billet transporter 143 which includes a base 145 formed of rollers, side walls 146A and 146B outwardly opening from base 145 and connected at opposite longitudinal ends to pivot arms 147A and 147B which are pivotable about an axis 149. Transporter 143 receives a heated billet 148 (shown in phantom in FIG. 6) from a furnace (not shown) via a gravity roll conveyor 151. Preferably, the rolls of conveyor 151 each have a continuously varying diameter, from a larger diameter at one end to a smaller diameter at the other end, and are placed in an opposing pattern to form a channel down the center of the conveyor, thus eliminating the need for side guides.

Side walls 146A and 146B are arranged so that when pivot arms 147A and 147B are rotated about pivot axis 149, a billet in transporter 143 will roll over side wall 146A into loader tray 117.

Figure 8:
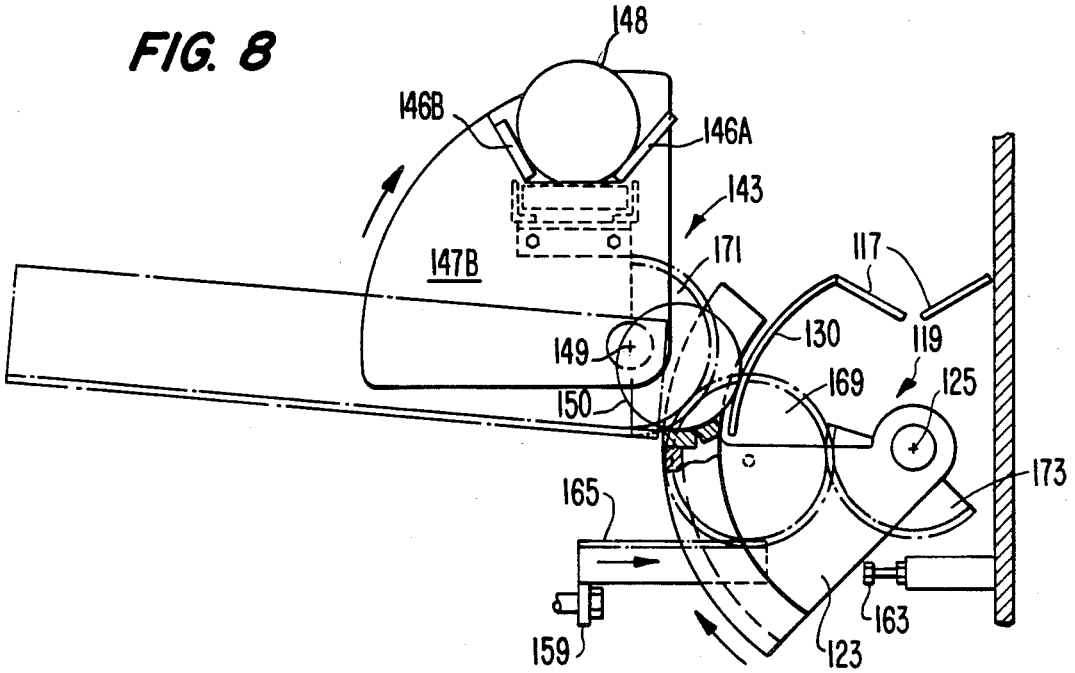
FIGS. 8 and 9, are simplified illustrations of FIG. 7 showing sequential positions of the loading assembly during operation.
Figure 9:
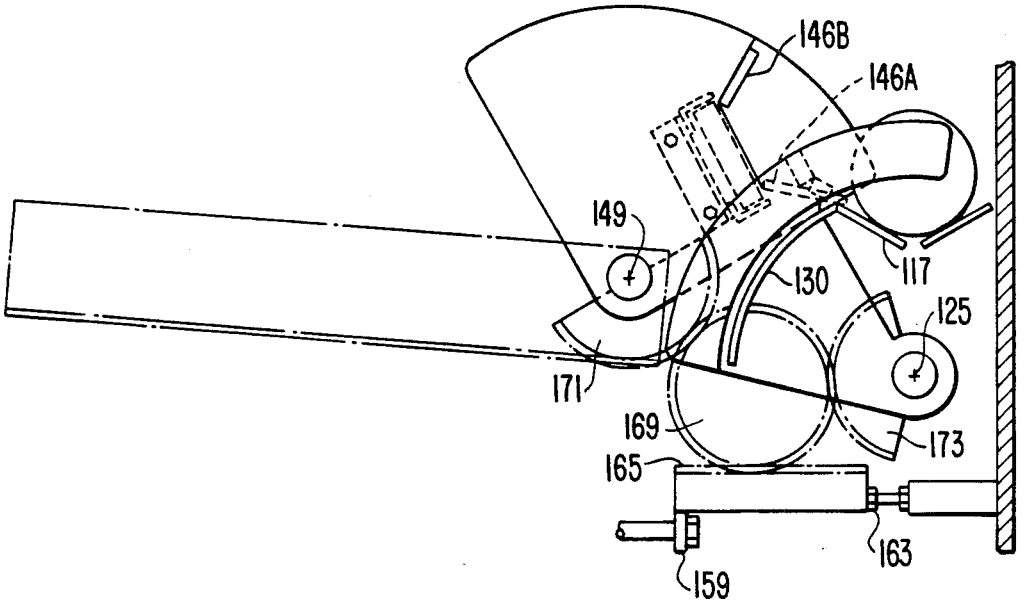

FIG. 7 illustrates the drive mechanism for moving the pressure disc, die and billet transporters 119, 133 and 143, respectively. FIGS. 8 and 9 show sequential positions of the transporters during a loading operation. As shown in FIGS. 7 to 9, the drive mechanism for the loading assembly includes a cylinder 157 having its piston 159 connected to one end of a rack 161. A sensor 163 is positioned opposite to the other end of rack 165 to provide a control signal when engaged by rack 161 during operation. Rack 161 is supported by a roller 164 which urges rack 161 upwardly. Rack 161 has teeth 165 on its upper surface which engage the teeth of a ring gear 169. Ring gear 169 in turn engages the teeth of a further ring gear 171 which is attached to arm 147B of billet transporter 143 and which rotates about pivot axis 149. Ring gear 169 further engages the teeth of partial ring gear 173 which is attached to arm 127A of pressure disc transporter 119 and which rotates about pivot axis 125.

Referring to FIGS. 7 and 8, piston 159 is shown in its fully retracted position, which is the position at which the transporter trays 119, 133 and 143 would be loaded with their charges from their respective chutes and conveyor. FIG. 8 shows a billet 148 and a pressure disc 118 loaded in respective transporters 143 and 119. A die loaded in transporter 133 cannot be seen in FIG. 8. In order to simultaneously transport a die, billet and pressure disc into the loader tray 117, cylinder 157 is actuated to extend piston 159 thereby moving rack 161 to the right in FIG. 8. This causes a counterclockwise rotation of ring gear 169 which causes ring gear 171 and partial ring gear 173 each to rotate in a clockwise direction, pivoting the respective transporters in the direction indicated by the arrows in FIG. 8 to the position shown in FIG. 9. Piston 159 is extended by a distance necessary to rotate the respective transporters to a position which allows their respective charges to roll by the force of gravity into the loader tray 117 as shown in FIG. 9 The extension of piston 159 can be set by a horizontal adjustment of sensor 163. Upon engaging sensor 163, piston 159 is retracted, causing all the gears to move in the reverse direction for placing the respective transporters in a position for receiving a new die, billet and pressure disc, respectively.

Once loader tray 117 is loaded with a die, billet and pressure disc as previously described, the cylinder-piston 129 (FIG. 6) is actuated for extending its piston forward to push the die, billet and pressure disc as a unit into the throughbore of a container. The piston of cylinder 129 is extended a sufficient distance to ensure that the pressure disc is disposed entirely within the container so that the turret is free to rotate for placing the loaded container into alignment with the extrusion axis of the press.

Figure 10:
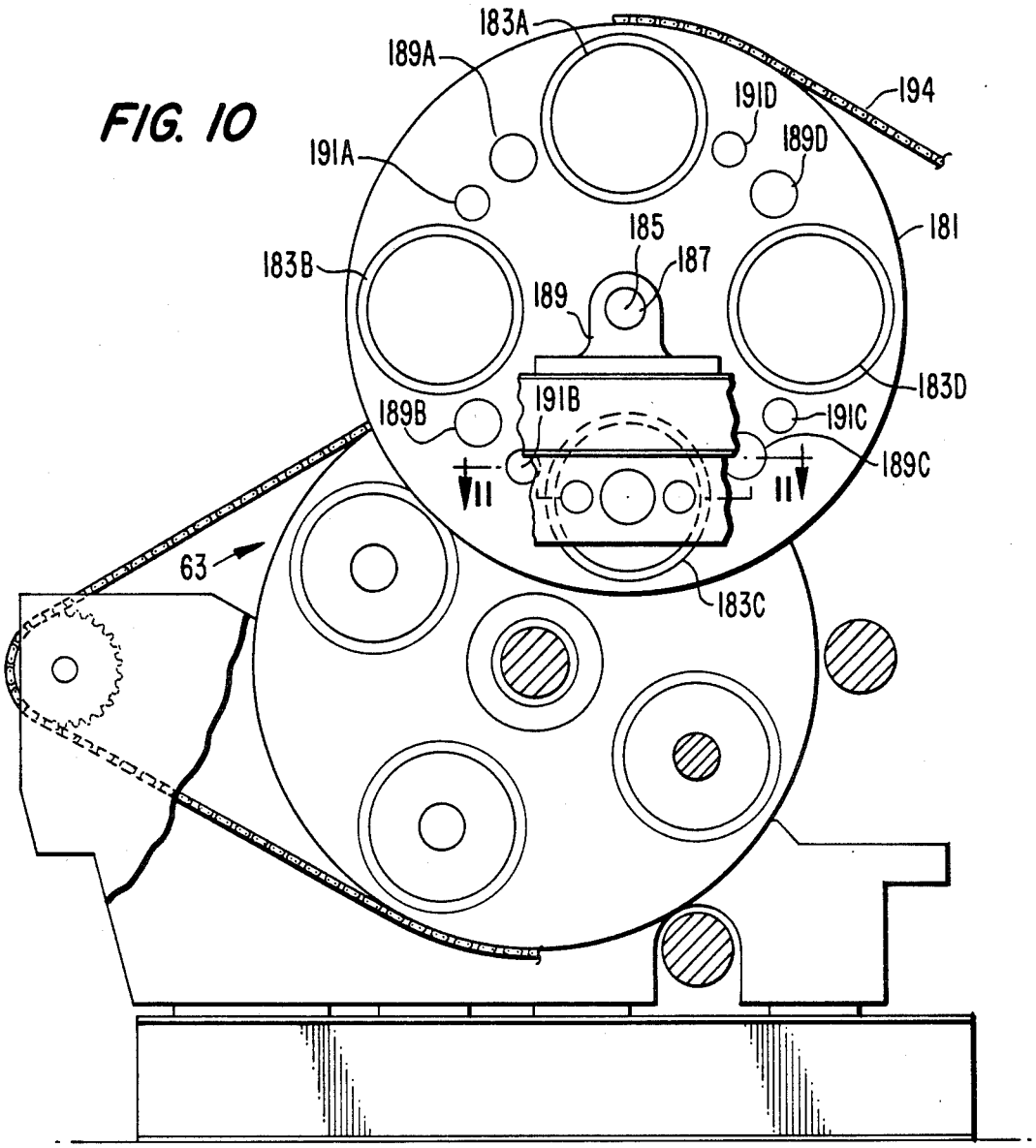
FIG. 10 is an end elevational view of a container changing and discard turret in combination with the press turret of FIG. 3 according to a further aspect of the invention.
Figure 11:
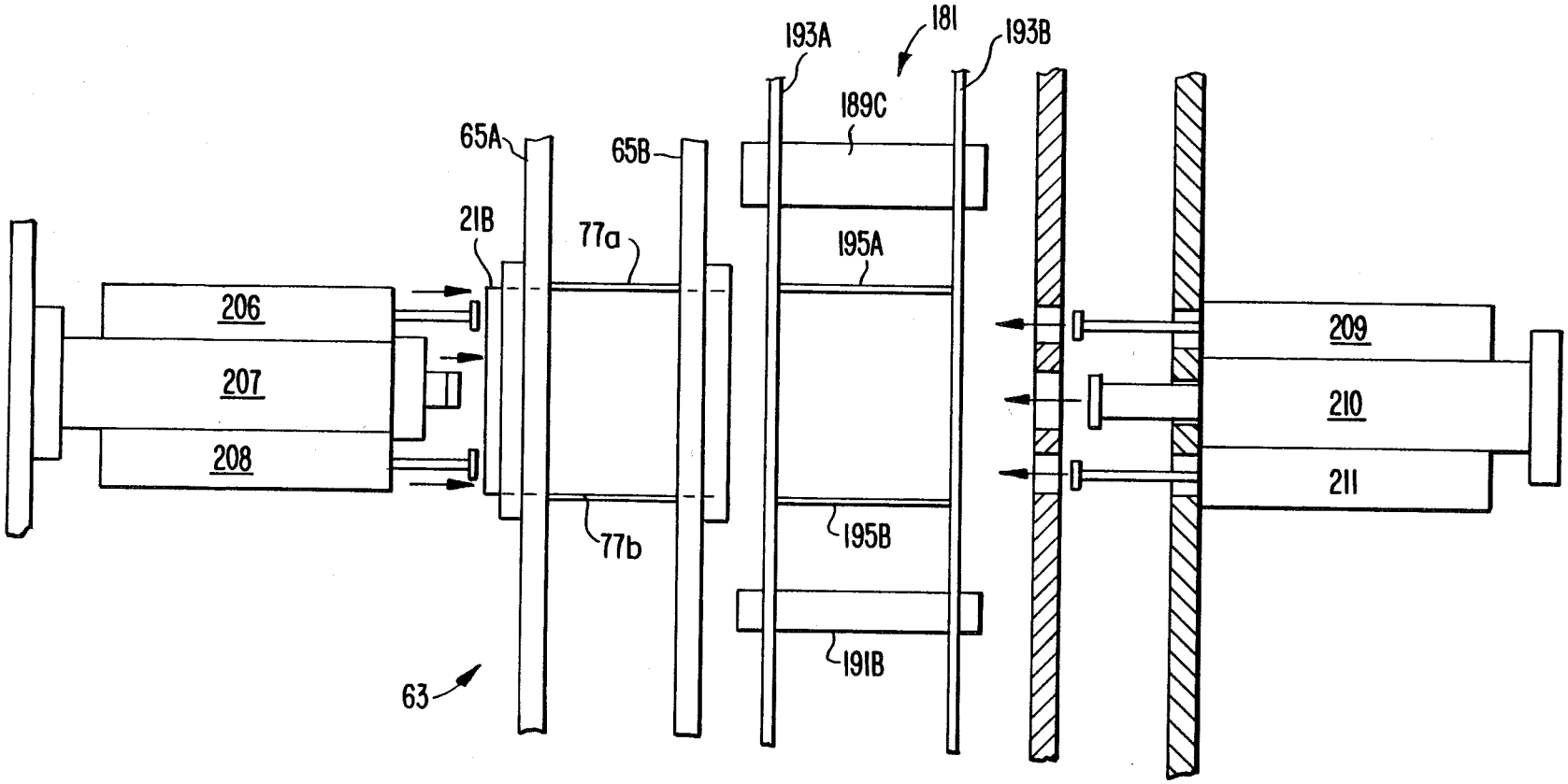
FIG. 11 is a partial sectional view of FIG. 10 along line 11—11 and additionally showing the cylinder-pistons for transferring a container between turrets and for ejecting a discard from a press container into a discard canister of the container changing and discard turret.

FIGS. 10 and 11 illustrate, according to a further aspect of the invetnion, a second turret in operative relation to the press turret illustrated in FIG. 3 for the purposes of facilitating the changing of a press container in the press turret (for example to permit the extrusion of a different diameter billet) and to facilitate the removal of discard from a container at the conclusion of an extrusion cycle. Referring to FIG. 10, there is illustrated a container changing and discard turret 181 which has four container holders 183A through 183D disposed 90° apart about an axis of rotation 185 provided by a shaft 187 supported in a bearing block 189 which is suitably mounted via a steal framework 190 comprised of, for example I-beams, for mounting the container changing and discard turret 181 above the press turret 63 as shown. Turret 181 is rotatably driven, like turret 63, by a chain 194 (partially shown) and a high inertia motor and brake system (not shown).

Container changing and discard turret 181 also includes a plurality of discard canisters disposed about axis 185. Preferably there is a first set of canisters 189A through 189D which are sized for receiving a discard of one diameter and a second set of discard canisters 191A through 191D which are sized for receiving a discard of a different diameter. For example, the discard canisters of one set each might have an inside diameter of 6½ inches and the canisters of the other set each may have an inside diameter of 5 inches, depending on the size of the billet which is being extruded during a given period.

FIG. 11 illustrates a sectional view of the press turret 63 and container changing and discard turret 181 of FIG. 10, in combination with cylinder-piston assemblies which are required for changing containers and for removing the discard from a container. FIG. 11 shows the circular plates 65A and 65B of press turret 63, with a container 21B being slidably supported on guide bars 77A and 77B. In FIG. 11 container 21B is aligned with the container changing and discard position of press turret 63. The container changing and discard turret 181 is shown as also comprising two circular plates 193A and 193B and each of the container holders in turret 181 comprise registered openings in circular plates 193A and 193B with diametrically opposed guide bars 195A and 195B connecting the plates at the peripheries of each pair of openings in a similar manner as the container holders of press turret 63. The container changing and discard turret of FIG. 11 is shown with container holder 183C aligned for receiving the container 21B of press turret 63. Guide bars 195A and 195B of container holder 183C are thus positioned to correspond with the location of the axial grooves of container 21B in the container changing and discard position of press turret 63.

Figure 12:
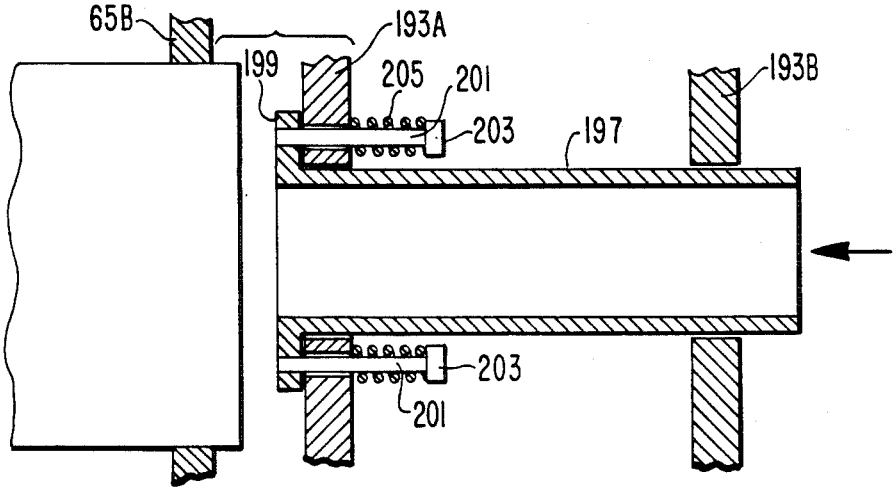
FIG. 12 is a partial side sectional view of the container changing and discard turret showing a discard canister in a reaction mounting according to another feature of the invention.

Referring to FIG. 12, each discard canister 189A to 189D and 191A to 191D includes a cylinder 197 having a collar 199 at the end of the canister adjacent the press turret. At least two bolts 201 mounted diametrically opposite one another with respect to the cylinders are fastened to collar 199 and extend through circular plate 193A to terminate in a bolt head 203. A compression spring 205 is supported on each bolt between plate 193A and bolt head 203. Each discard canister is therefore normally biased to a position away from the press turret so as not to interfere with the rotation of the press turret.

As shown in FIG. 11, a set of three cylinder-pistons 206 to 208 is located to the left of press turret 63 and a set of three cylinder-pistons 209 to 211 is located to the right of the container changing and discard turret 181. The two outer cylinder-pistons of each set are used to push a container from one turret to the other. For example, as shown in FIG. 10 the two outer cylinder-pistons 206 and 208 to the left of press turret 63 are used to push container 21B into the container holder of the container changing and discard turret 181. Similarly, if container 21B were, for example, located in a container holder of container changing and discard turret 181, the two outer cylinder-pistons 209 and 211 to the right of the container changing and discard turret 181 would be utilized to push container 21B into press turret 63.

It should thus be appreciated that the arrangement of turrets 63 and 181 as illustrated in FIGS. 10 and 11 will permit a press container to be removed from press turret 63 and be replaced with a different container by a relatively simple operation over a period of minutes rather than hours as in the past. Such an operation would involve indexing the press turret to place the container to be removed into the container changing and discard position (the position of container 21B in FIG. 3); indexing turret 181 to place a vacant container holder at the container changing and discard station; actuating cylinder-piston 98 (FIG. 4) to disengage lever 87 from groove 83; extending and retracting cylinder-pistons 206 and 208 to push the press container from the press turret 63 into the vacant container holder of turret 181; indexing turret 181 to bring a replacement container into alignment with the now vacant container holder of the press turret; extending and retracting cylinder-pistons 209 and 211 to push the replacement container into the vacant container hold of the press turret; and de-energizing cylinder-piston 98 so that lever 87 engages the groove 83 of the replacement cylinder.

In order to remove a discard from a press container, such as container 21B, the appropriately sized discard canister of container changing and discard turret is rotated into alignment with the cavity of container 21B in the discard position. Once this is done, the center cylinder-piston 210 to the right of container changing and discard turret 181 is extended to push the discard canister toward container 21B so as to press collar 199 of the canister against the end face of the container. Thereafter, the center cylinder-piston 207 to the left of press turret 63 is actuated for pushing the discard out of the container into the discard canister. The discard canister, and thus the cylinder piston 210, must present a reaction force against the container sufficient to counter the force required to push the discard out of the press container so that the press turret is not exposed to a bending torque. Once the discard is pushed entirely into the discard canister, cylinder-piston 210 and cylinder-piston 207 are fully retracted, permitting both turrets 63 and 181 to be indexed to the next position for subsequent operations.

It will be understood that the above description of the present invention is susceptible to various modifications, changes and adaptations, and the same are intended to be comprehended within the meaning and range of equivalents of the appended claims.

What is claimed is:

1. An indirect extrusion process for producing an extrusion product from a hot metal billet in a press having an extrusion axis, comprising:

providing a multiple container press turret having a plurality of press containers mounted about an axis of rotation of the press turret, and with the press containers each having an axial throughbore and being mounted on the press turret to be substantially axially stationary during extrusion of a billet;

mounting the pressure turret to be substantially axially stationary and rotatable about said axis of rotation for sequentially rotating the press containers, respectively, from a loading station off of the extrusion axis to an extrusion station in which the press container is coaxially aligned with the extrusion axis;

loading a die, a hot billet and a pressure disc into the axial throughbore of a container while such container is in the loading station so that the billet is sandwiched between the die and the pressure disc, with the die having an opening through which the billet is to be extruded to form an extrusion product and with the pressure disc having opposite radial faces and a maximum outer diameter between such faces which is slightly less than the diameter of the axial throughbore to define a diametrical clearance between the pressure disc and the press container;

rotating the turret to bring the loaded container into the extrusion station;

at the extrusion station, locating a bolster adjacent the radial face of the pressure disc which is remote from the billet and axially fixing the bolster to substantially prevent axial movement of the pressure disc in a direction toward the bolster during extrusion and so that the bolster exerts a relatively insignificant axial force against the container; and pressing an elongated stem having an axial passage into the throughbore of the container and against the die to press the die toward the bolster to cause the billet to be extruded through the die to create an extrusion product which exits the container through the axial passage in the stem, while extrusion of the billet through the diametrical clearance between the pressure disc and the container is substantially avoided.

2. A process as defined in claim 1, wherein said loading step includes assembling the die, billet and pressure disc into a unit outside of a press container, and loading the unit into a press container at the loading station.

3. A process as defined by claim 1, including providing each of the billet, pressure disc and bolster with a central passage concentric with the opening in the die, inserting a mandrel, having an outer diameter less than the diameter of the opening in the die, through the central passages of the bolster, pressure disc and billet; and wherein said pressing step includes pressing the die over the mandrel to extrude a tubular extrusion product.

4. An indirect extrusion process for producing an extrusion product from a hot metal billet in a press having an extrusion axis, comprising:

mounting a press container, having an axial throughbore, to be substantially axially stationary during extrusion of a billet;

loading a hot billet, a die and a pressure disc into the axial througbore of the press container so that the billet is sandwiched between the die and pressure disc, with the die having an opening through which the billet is to be extruded to form an extrusion product, with the pressure disc having opposite radial faces and a maximum outer diameter between such faces which is slightly less than the diameter of the axial throughbore to define a diametrical clearance between the pressure disc and the pressure container, and with the hot billet and the pressure disc each being provided with a central passage concentric with the opening in the die;

locating a bolster, which has a central passage concentric with the opening in the die, adjacent the radial face of the pressure disc which is remote from the billet and axially fixing the bolster to substantially prevent axial movement of the pressure disc in a direction toward the bolster during extrusion and so that the bolster exerts a relatively insignificant axial force against the container;

inserting a mandrel, having an outer diameter less than the diameter of the opening in the die, through the central passages of the bolster, the pressure disc and the billet;

pressing an elongated stem having an axial passage into the throughbore of the container and against the die to press the die over the mandrel and toward the bolster to cause the billet to be extruded through the die to create a tubular extrusion product which exits the container through the axial passage in the stem, while extrusion of the billet through the diametrical clearance between the pressure disc and the container is substantially avoided;

providing the mandrel with a shoulder having a diameter slightly greater than the diameter of the opening in the die; and, simultaneously moving the shoulder of the mandrel in a direction toward the die and rotating the mandrel for shearing the extrusion product from a residual portion of the billet.

5. A process as defined by claim 1, wherein the pressure disc has a circumferential surface and further including providing the pressure disc with an annular recess centrally disposed in the circumferential surface.

6. An indirect extrusion process for producing an extrusion product from a hot metal billet in a press having an extrusion axis, comprising:

providing a multiple container press turret having a plurality of press containers, each having an axial throughbore, disposed about an axis of rotation of the press turret;

releasably mounting each press container on the turret against axial movement relative to the press turret;

mounting the press turret to be substantially axially stationary during extrusion of a billet and rotatable about said axis of rotation for sequentially rotating the press containers, respectively, from a loading station off of the extrusion axis to an extrusion station in which the press container is coaxially aligned with the extrusion axis;

loading a hot billet, a die and a pressure disc into the axial throughbore of a press container disposed at said loading station so that the billet is sandwiched between the die and the pressure disc, with the die having an opening through which the billet is to be extruded to form an extrusion product and with the pressure disc having opposite radial faces and a maximum outer diameter between such faces which is slightly less than the diameter of the axial throughbore to define a diametrical clearance between the pressure disc and the press container;

rotating the turret to bring the loaded container into said extrusion station;

at the extrusion station, locating a bolster adjacent the radial face of the pressure disc which is remote from the billet and axially fixing the bolster to substantially prevent axial movement of the pressure disc in a direction toward the bolster during extrusion and so that the bolster exerts a relatively insignificant axial force against the container;

pressing an elongated stem having an axial passage into the throughbore of the container to press the die toward the bolster causing the billet to be extruded through the die to create an extrusion product which exits the container through the axial passage in the stem, while extrusion of the billet through the diametrical clearance between the pressure disc and the container is substantially avoided;

providing a second rotatable turret having a plurality of container holders each for axially slidably accommodating a press container; mounting the second turret axially adjacent the press turret so that the second turret can be rotated for placing one of the holders into a transfer position wherein a press container can be transferred from one to the other of the turrets by sliding the container in an axial direction after releasing such container for axial movement.

7. A process as defined by claim 6, wherein said step of mounting each press container includes mounting each press container on guide bars fixed to the press turret and oriented parallel to the axial direction of the press turret, and providing the press turret with a plurality of releasable latches each for releasably latching a respective one of the press containers for selectively allowing and disallowing movement of a container in the axial direction.

8. A process as defined by claim 6, wherein at the conclusion of said pressing step a discard portion of the billet remains between the die and pressure disc in the throughbore of a container; and said step of providing a second turret includes providing the second turret with a plurality of discard canisters; and said process further includes the steps of rotating the second turret to align one of the discard canisters with the press container containing the discard portion of billet; and pushing the die, discard portion of billet and pressure disc from such press container into such discard canister.

9. A process as defined by claim 8, including rotating the press turret after said pressing step to bring the container containing the discard portion of billet into a discard station which is off of the extrusion axis, and wherein said pushing step is performed at the discard station.

10. A process as defined by claim 8, wherein each discard canister has first and second axial positions, the first axial position being axially remotely from the press turret and the second axial position being axially adjacent the press turret, the discard canister is spring biased to normally be in the first axial position and said process further includes applying a force against the canister to move the canister to the second position and to maintain the canister in the second position during said pushing step.

11. An indirect extrusion process for producing an extrusion product from a hot metal billet in a press having an extrusion axis, comprising:

providing a multiple container pressure turret having a plurality of press containers, each having an axial throughbore, disposed about an axis of rotation of the press turret;

mounting the press turret to be substantially axially stationary during extrusion of a billet and rotatable about said axis of rotation for sequentially rotating the press containers, respectively, from a loading station off of the extrusion axis to an extrusion station in which the press container is coaxially aligned with the extrusion axis;

loading a hot billet, a die and a pressure disc into the axial throughbore of a press container disposed at said loading station so that the billet is sandwiched between the die and the pressure disc, with the die having an opening through which the billet is to be extruded to form an extrusion product and with the pressure disc having opposite radial faces and a maximum outer diameter between such faces which is slightly less than the diameter of the axial throughbore to define a diametrical clearance between the pressure disc and the press container;

rotating the turret to bring the loaded container into said extrusion station;

at the extrusion station, locating a bolster adjacent the radial face of the pressure disc which is remote from the billet and axially fixing the bolster to substantially prevent axial movement of the pressure disc in a direction toward the bolster during extrusion and so that the bolster exerts a relatively insignificant axial force against the container;

pressing an elongated stem having an axial passage into the throughbore of the container to press the die toward the bolster causing the billet to be extruded through the die to create an extrusion product which exits the container through the axial passage in the stem, while extrusion of the billet through the diametrical clearance between the pressure disc and the container is substantially avoided; and wherein at the conclusion of said pressing step a discard portion of the billet remains between the die and the pressure disc and said process further includes:

providing a second rotatable turret having a plurality of discard canisters spaced apart about the axis of rotation of the second rotatable turret; rotating the second turret to align one of the discard canisters with the press container containing the discard portion of billet; and pushing the die, the discard portion of the billet and the pressure disc from such press container into such canister.

12. A process as defined by claim 11, including rotating the press turret after said pressing step to bring the container containing the discard portion of billet into a discard station which is off of the extrusion axis, and wherein said pushing step is performed at the discard station.

13. A process as defined by claim 11, wherein each discard canister has first and second axial positions, the first axial position being axially remote from the press turret and the second axial position being axially adjacent the press turret, the discard canister is spring biased to normally be in the first axial position and said process further includes applying a force against the canister to move the canister to the second position and t maintain the canister in the second position during said pushing step.

14. A method for changing a press container of a multiple container press turret of a metal extrusion press having an extrusion axis, the press turret being rotatable for rotating the containers into at least one off-axis station off of the extrusion axis, comprising:

mounting each press container in a container holder of the press turret so as to be axially slidable;

providing a second turret axially adjacent the press turret and having a plurality of container holders constructed for axially slidably accommodating a press container;

rotating the press turret to place one of the press containers at the off-axis station;

rotating the second turret to place one of its container holders in axial alignment with the press container at the off-axis station; and sliding the press container from the holder of the press turret to the holder of the second turret.

15. The method of claim 14 and further comprising:

rotating the second turret to place a press container disposed in a holder of the second turret in alignment with a vacant container holder of the press turret at the off-axis station; and sliding the press container into the vacant container holder of the press turret.

16. A method for transferring a press container relative to a container holder in a rotatable press turret of a metal extrusion press, the press turret having a plurality of container holders spaced apart about an axis of rotation of the press turret, each container holder of the press turret arranged for axially slidably accommodating a press container, the press turret having an extrusion axis and an off-axis station off of the extrusion axis, said method comprising:

providing a second turret axially adjacent the press turret and having a plurality of container holders constructed for axially slidably accommodating a press container;

rotating the press turret to place one of its container holders at the off-axis station;

rotating the second turret to place one of its container holders at the off-axis station;

slidably transferring between the press turret and the second turret a press container disposed in one of the container holders at the off-axis station.

17. A method for removing a discard from a press container of a multiple container press turret of a metal extrusion press having an extrusion axis, the press turret being rotatable for rotating the container into at least one off-axis station off of the extrusion axis, comprising:

providing a second turret axially adjacent the press turret and having a plurality of discard canisters spaced apart about an axis of rotation of the second turret and being constructed for receiving the discard;

rotating a press container containing a discard into the off-axis station;

rotating the second turret to place a discard canister at the off-axis station axially adjacent the press container containing the discard; and pushing the discard out of the press container and into the discard canister.

18. A method for shearing a metal extrusion product from a residual portion of a billet at the conclusion of an extrusion cycle of a metal extrusion press, wherein the extrusion product is formed by pressing the billet through a diametrical clearance formed between a die having a die hole and a mandrel inserted in the die hole, and the mandrel has a shoulder which has a diameter slightly greater than the diameter of the die hole, said method comprising:

simultaneously moving the shoulder of the mandrel in a direction toward the die and rotating the mandrel for shearing the extrusion product from the residual portion of the billet.

19. A container transfer apparatus for use with a metal extrusion press having an extrusion axis and a press container slidably mounted in a press container holder which can be moved from a first position aligned with the extrusion axis to a second position off of the extrusion axis, said container transfer apparatus comprising:

a transfer turret rotatable about a transfer turret axis parallel to the extrusion axis of the press and supporting at least two transfer container holders spaced apart about the transfer turret axis, each transfer container holder having guide means for slidably mounting a press container, said transfer turret being rotatable for placing a respective one of the transfer container holders in axial alignment with a press container holder located at the second position; and means for sliding a press container from the press container holder located at the second position into a first one of the transfer container holders which is brought into axial alignment therewith, and for sliding a press container disposed in a second one of the transfer container holders into a press container holder located at the second position and in axial alignment with such transfer container holder.

* * * * *